US010833415B2

(12) United States Patent
Rogers

(10) Patent No.: US 10,833,415 B2
(45) Date of Patent: Nov. 10, 2020

(54) RADIO FREQUENCY CIRCUIT BOARD WITH MICROSTRIP-TO-WAVEGUIDE TRANSITION

(71) Applicant: THE BOEING COMPANY, Chicago, IL (US)

(72) Inventor: John E. Rogers, Owens Cross Roads, FL (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/381,893

(22) Filed: Apr. 11, 2019

(65) Prior Publication Data

US 2020/0328521 A1 Oct. 15, 2020

(51) Int. Cl.
*H01Q 13/00* (2006.01)
*H01Q 19/06* (2006.01)
(Continued)

(52) U.S. Cl.
CPC ..... *H01Q 9/0457* (2013.01); *H01Q 1/38* (2013.01); *H01Q 1/48* (2013.01); *H01Q 9/0442* (2013.01);
(Continued)

(58) Field of Classification Search
CPC ..... H01P 11/003; H01P 3/08; H01P 11/002; H01P 3/12; H01P 5/107; H01Q 13/06;
(Continued)

(56) References Cited

U.S. PATENT DOCUMENTS 6,052,087 A * 4/2000 Ishikawa ..... H01Q 13/10 343/700 MS
6,424,318 B1 * 7/2002 Bergstedt ..... H01Q 15/08 343/911 R
(Continued)

FOREIGN PATENT DOCUMENTS

EP 1738432 A2 1/2007
JP 08125404 A * 5/1996
(Continued)

OTHER PUBLICATIONS

Iizuka, H. et al., "Millimeter-wave microstrip line to waveguide transition fabricated on a single layer dielectric substrate." IEICE Transactions on Communications 85, No. 6 (2002): 1169-1177.
(Continued)

*Primary Examiner* — Vibol Tan
(74) *Attorney, Agent, or Firm* — Armstrong Teasdale LLP

(57) ABSTRACT

A radio frequency (RF) printed circuit board (PCB) including a ground plane, a microstrip transmission line, a patch antenna element, a waveguide, and a dielectric lens. The RF PCB includes a first substrate having a top surface on which the patch antenna element is disposed, the patch antenna element including a slot aperture. The microstrip transmission line is disposed between the first substrate and a second substrate, and is configured to be electromagnetically coupled to the patch antenna element through the slot aperture. The ground plane is disposed on a third substrate and is electromagnetically coupled to the microstrip transmission line. The waveguide includes an aperture attached to the top surface and encloses the patch antenna element. The waveguide is configured to be electromagnetically coupled to the patch antenna element. The dielectric lens is disposed on the patch antenna element and extends into the aperture of the waveguide.

20 Claims, 5 Drawing Sheets

(51) Int. Cl.

| | |
|---|---|
| ***H01Q 9/04*** | (2006.01) |
| ***H01Q 15/08*** | (2006.01) |
| ***H01Q 1/38*** | (2006.01) |
| ***H01Q 1/48*** | (2006.01) |
| ***H01Q 13/10*** | (2006.01) |

(52) U.S. Cl.
CPC ..... *H01Q 13/00* (2013.01); *H01Q 13/106* (2013.01); *H01Q 15/08* (2013.01); *H01Q 19/06* (2013.01)

(58) Field of Classification Search
CPC .... H01Q 13/106; H01Q 1/38; H01Q 21/0075; H01Q 21/065; H01Q 9/065; H01Q 9/0457; H01Q 9/0442; H01Q 1/48; H01Q 15/08; H01Q 19/06; H01Q 19/062; H01Q 13/00; H01Q 13/20; H01Q 13/206; H01Q 13/12; H01Q 13/10; H01Q 13/22
See application file for complete search history.

(56) References Cited

U.S. PATENT DOCUMENTS

| | | | | |
|---|---|---|---|---|
| 7,224,944 | B2 | 5/2007 | McEwan et al. | |
| 7,570,221 | B2 * | 8/2009 | May | H01Q 15/10 343/753 |
| 7,994,996 | B2 | 8/2011 | Rebeiz et al. | |
| 8,018,384 | B2 * | 9/2011 | Floyd | H01Q 9/0457 343/700 MS |
| 9,531,078 | B2 | 12/2016 | Taptic et al. | |
| 9,590,300 | B2 | 3/2017 | Artemenko et al. | |
| 9,766,330 | B2 | 9/2017 | Nagaishi et al. | |
| 9,831,562 | B2 | 11/2017 | Caratelli et al. | |
| 9,865,935 | B2 * | 1/2018 | Miraftab | H01Q 21/005 |
| 10,116,051 | B2 | 10/2018 | Scarborough et al. | |
| 10,224,638 | B2 * | 3/2019 | Artemenko | H01Q 15/08 |
| 10,312,601 | B2 * | 6/2019 | Zhai | H01Q 21/064 |
| 10,553,945 | B2 * | 2/2020 | Yong | H01Q 3/26 |
| 2017/0324171 | A1 | 11/2017 | Shehan | |
| 2017/0352944 | A1 * | 12/2017 | Komulainen | H01Q 21/28 |
| 2019/0237844 | A1 * | 8/2019 | Rogers | H01Q 1/28 |
| 2019/0312326 | A1 * | 10/2019 | Rogers | H01P 5/08 |
| 2020/0067165 | A1 * | 2/2020 | Rogers | H01P 3/08 |
| 2020/0067201 | A1 * | 2/2020 | Rogers | H01P 11/003 |

FOREIGN PATENT DOCUMENTS

| | | | | |
|---|---|---|---|---|
| WO | 2005094352 | A2 | 10/2005 | |
| WO | WO-2019032047 | A1 * | 2/2019 | H02J 50/001 |

OTHER PUBLICATIONS

Lin, T. et al., "CPW to waveguide transition with tapered slotline probe." IEEE Microwave and Wireless Components Letters 11, No. 7 (2001): 314-316.

Kaneda, N. et al., "A broadband microstrip-to-waveguide transition using quasi-Yagi antenna." In Microwave Symposium Digest, 1999 IEEE MTT-S International, vol. 4, pp. 1431-1434. IEEE, 1999.

Simon, W. et al., "A novel coplanar transmission line to rectangular waveguide transition." In Microwave Symposium Digest, 1998 IEEE MTT-S International, vol. 1, pp. 257-260. IEEE, 1998.

Grabherr, W. et al., "Microstrip to waveguide transition compatible with mm-wave integrated circuits." IEEE transactions on microwave theory and techniques 42, No. 9 (1994): 1842-1843.

Ponchak, G. et al., "A new rectangular waveguide to coplanar waveguide transition." NASA Technical Memorandum 102477, IEEE MTT-S International Microwave Symposium, Dallas, TX, May 8-10, 1990 (6 pgs), downloaded from http://scholar.google.com/scholar_url?url=https%3A%2F%2Fntrs.nasa.gov%2Farchive%2Fnasa%2Fcasi.ntrs.nasa.gov%2F19900011947.pdf&hl=en&sa=T&oi=gga&ct=gga&cd=0&d=14273170423141837187&ei=u5pcXIH6K9aMyQTsv5fIBw&scisig=AAGBf.

* cited by examiner

RADIO FREQUENCY CIRCUIT BOARD WITH MICROSTRIP-TO-WAVEGUIDE TRANSITION

FIELD

The field of the disclosure relates generally to radio frequency systems and, more specifically, to a radio frequency printed circuit board having a microstrip-to-waveguide transition.

BACKGROUND

Waveguides are generally well-suited for low-loss radio frequency (RF) or microwave signal transmission. However, waveguides are generally poorly-suited for use directly with RF printed circuit boards (PCBs). Accordingly, coaxial adapters are often used as an intermediate for transitioning from an RF PCB to a waveguide. Such transitions generally include a planar trace, such as a microstrip, onto which a coax-to-microstrip adapter may be soldered or otherwise attached. The coax-to-microstrip adapter is then connected to a waveguide-to-coax adapter, either directly at the coax connector or remotely via a coaxial cable. The coaxial conductor in the adapter is positioned in the cavity of the waveguide some distance corresponding to the desired operating frequency of the waveguide. Alternatively, the waveguide itself can be modified to enable insertion of a feeding RF PCB. Other alternative transitions are available that yield varying levels of loss and generally increase the size, weight, and power consumption (SWaP) of the overall RF PCB. Moreover, known transitions tend to be cost prohibitive at high operating frequencies. Accordingly, it is desirable to have a microstrip-to-waveguide transition with low loss, that reduces or adds little SWaP, and does not add significantly to cost.

BRIEF DESCRIPTION

One aspect of the present disclosure includes a radio frequency RF PCB including a ground plane, a microstrip transmission line, a patch antenna element, a waveguide, and a dielectric lens. The RF PCB includes a first substrate having a top surface on which the patch antenna element is disposed, the patch antenna element including a slot aperture. The microstrip transmission line is disposed between the first substrate and a second substrate, and is configured to be electromagnetically coupled to the patch antenna element through the slot aperture. The ground plane is disposed on a third substrate and is electromagnetically coupled to the microstrip transmission line. The waveguide includes an aperture attached to the top surface and encloses the patch antenna element. The waveguide is configured to be electromagnetically coupled to the patch antenna element. The dielectric lens is disposed on the patch antenna element and extends into the aperture of the waveguide.

Another aspect of the present disclosure includes a method of fabricating an RF PCB. The method includes disposing a patch antenna element on a first dielectric layer, disposing a microstrip transmission line on a second dielectric layer, and disposing a ground plane on a third dielectric layer. The patch antenna element includes a slot aperture. The method includes laminating, sequentially, at least the first dielectric layer, the second dielectric layer, and the third dielectric layer into a board assembly such that the microstrip transmission line is configured to be electromagnetically coupled to the ground plane and electromagnetically coupled to the patch antenna element through the slot aperture. The method includes disposing a dielectric lens on the patch antenna element. The method includes attaching an aperture of a waveguide to a top surface of the first dielectric layer and enclosing the patch antenna element such that the dielectric lens extends into the aperture of the waveguide. The waveguide is configured to be electromagnetically coupled to the patch antenna element through the dielectric lens.

The features, functions, and advantages that have been discussed can be achieved independently in various embodiments or may be combined in yet other embodiments further details of which can be seen with reference to the following description and drawings.

DETAILED DESCRIPTION

Embodiments of the systems described herein include an RF PCB having a microstrip-to-waveguide transition. The RF PCB includes a ground plane, a microstrip transmission line, and a patch antenna element. The patch antenna element is disposed on a top surface of the RF PCB and includes a slot aperture through which the patch antenna element is electromagnetically coupled to the microstrip transmission line. The slot aperture decreases the axial ratio of the antenna, resulting in reduced polarization loss. The microstrip transmission line is positioned, or embedded, in a layer between the ground plane and the patch antenna element. The ground plane reduces the effects of conductive environmental surfaces to which the microstrip-to-waveguide transition may be placed. In certain embodiments, a tuning element is positioned on another layer between the microstrip transmission line and the patch antenna element. The RF PCB includes a waveguide attached to the RF PCB and enclosing the patch antenna element. The RF PCB includes a dielectric lens disposed on the patch antenna element and extending into the aperture of the waveguide. The dielectric lens improves the signal performance over the microstrip-to-waveguide transition. The RF PCBs described herein may be fabricated, in certain embodiments, for example, by additive manufacturing methods, such as 3D printing, or by subtractive methods, such as wet etching.

Figure 1:
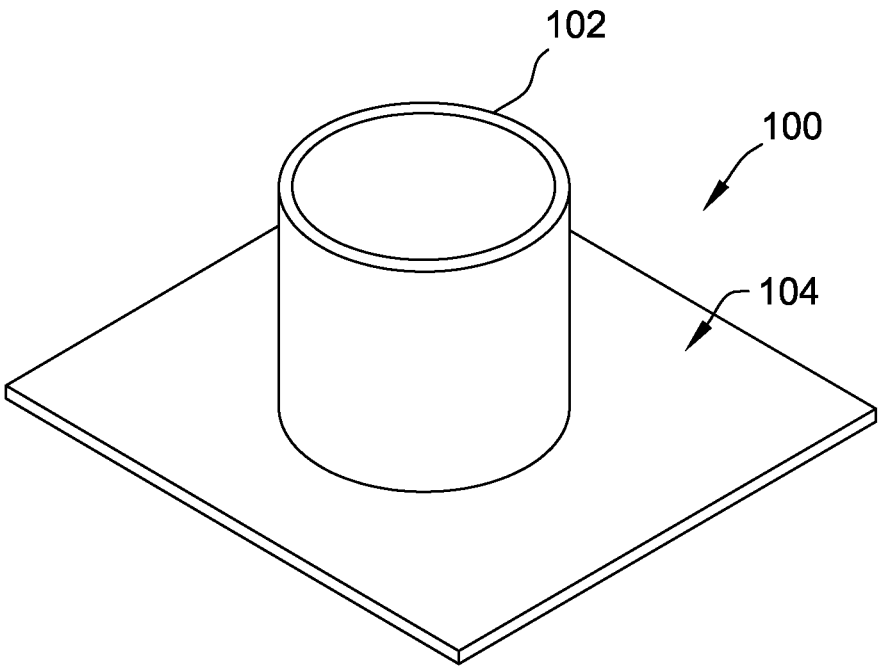
FIG. 1 is a perspective schematic diagram of an example RF PCB with a circular waveguide.
Figure 2:
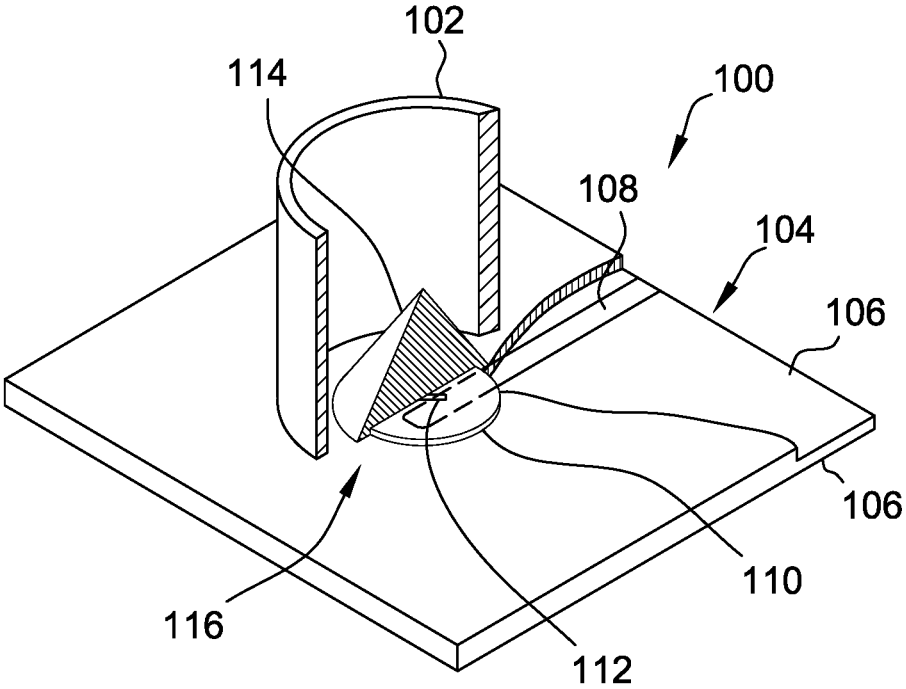
FIG. 2 is another perspective schematic diagram of the RF PCB shown in FIG. 1.

FIG. 1 is a perspective schematic diagram of an example RF PCB 100 with a circular waveguide 102. RF PCB 100 includes a board assembly 104. FIG. 2 is another perspective schematic diagram of RF PCB 100, with the substrate layers of board assembly 104 and waveguide 102 shown transparent to illustrate a ground plane 106, a microstrip transmission line 108, and a patch antenna element 110. Patch antenna element 110 includes a slot aperture 112 through which patch antenna element 110 may be electromagnetically coupled to microstrip transmission line 108, which feeds patch antenna element 110. A dielectric lens 114 is disposed on patch antenna element 110 and extends into an aperture 116 of waveguide 102. An RF signal radiated by patch antenna element 110 electromagnetically couples into waveguide 102 through dielectric lens 114. Dielectric lens 114 improves the coupling from patch antenna element 110 into waveguide 102. The microstrip-to-waveguide transition formed between microstrip transmission line 108 and waveguide 102 is simple and avoids the size, weight, and cost of coaxial adapters. Moreover, combining patch antenna element 110 with slot aperture 112 and dielectric lens 114 results in good insertion loss and good return loss performance for a given desired operating frequency.

Waveguide 102 has a shape and dimensions that define the range of signals (e.g., frequency and mode) that will propogate through waveguide 102. Waveguide 102, for example, may include a circular or rectangular waveguide, or any other shape of waveguide. Generally, waveguide 102 is dimensioned for microwave signals, or signals having a frequency between about 300 Megahertz (MHz) and about 300 Gigahertz (GHz). For example, in one embodiment, waveguide 102 is dimensioned for an operating frequency of 20 GHz. Likewise, microstrip transmission line 108, patch antenna element 110, slot aperture 112, and dielectric lens 114 size and shape are designed for efficient signal propogation at the desired operating frequency, and are further designed for impedance matching at, for example, the transition from microstrip transmission line 108 to waveguide 102. Generally, slot aperture 112 has a length and width corresponding to the desired operating frequency, and patch antenna element 110 has a diameter corresponding to the desired operating frequency. The orientation of slot aperture 112 is selected for efficient signal propogation for the desired operating frequency. Generally, microstrip transmission line 108 has a width corresponding to an impedance suitable for the operating frequency and for transitioning to patch antenna element 110. Generally, dielectric lens 114 has a shape designed to minimize impedance mismatches between patch antenna element 110 and waveguide 102. For example, dielectric lens 114 shown in FIG. 1 is conical in shape.

Figure 3:
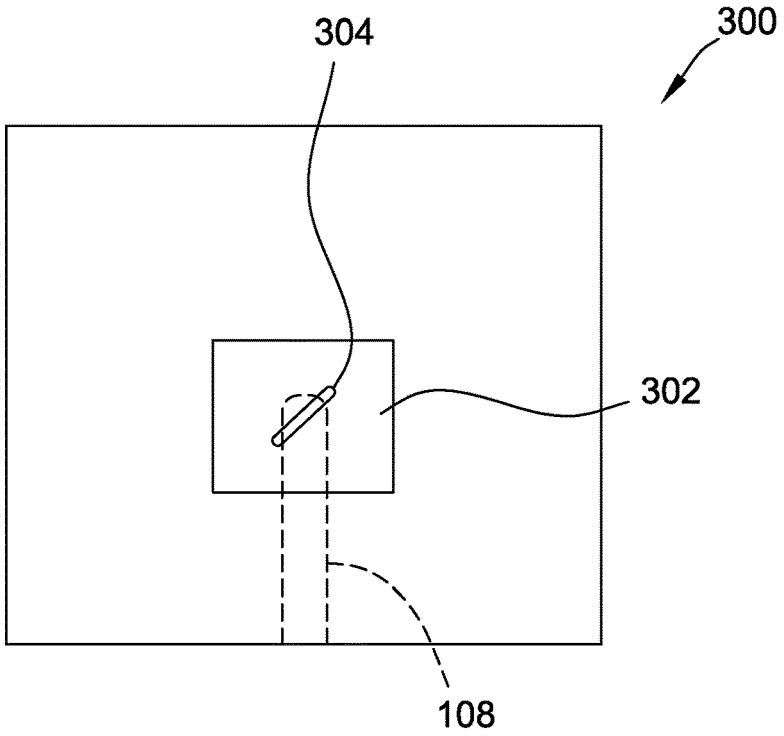
FIG. 3 is a top-view schematic diagram of an example RF PCB with a rectangular patch antenna.
Figure 4:
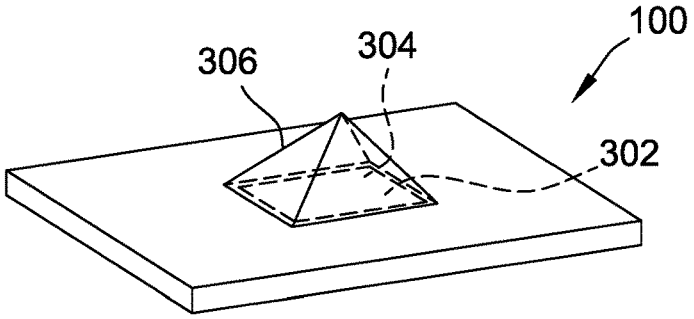
FIG. 4 is a perspective schematic diagram of the RF PCB shown in FIG. 3 with a dielectric lens.
Figure 5:
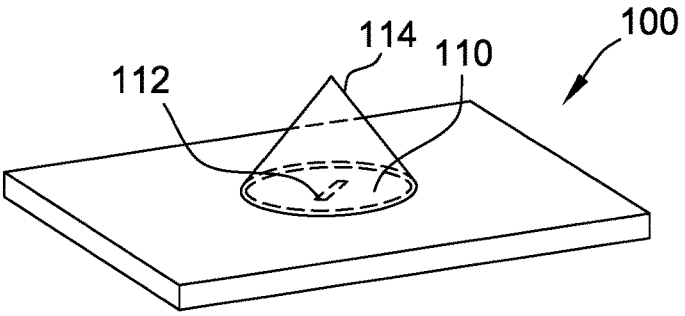
FIG. 5 is a perspective schematic diagram of another example RF PCB with a dielectric lens.

FIG. 3 is a top-view schematic diagram of an example RF PCB 300 with a rectangular patch antenna element 302. FIG. 4 is a perspective schematic diagram of RF PCB 300 shown in FIG. 3 with a dielectric lens 306. The rectangular shape of patch antenna element 302 is preferred for use with a rectangular waveguide due to the linearly polarized nature of rectangular waveguides. The dimensions (i.e., length and width) of patch antenna element 302 correspond to the desired operating frequency for RF PCB 300. Similarly, the pyramid shape of dielectric lens 306 enables efficient signal propogation between rectangular patch antenna element 302 and the waveguide (not shown). Likewise, FIG. 5 is a perspective schematic diagram of board assembly 104 with dielectric lens 114. Patch antenna element 110 includes a circular patch and dielectric lens 114 includes a conical dielectric lens, both of which are preferred for a circular waveguide, such as waveguide 102 shown in FIG. 1 and FIG. 2. The circular patch results in current densities having circular rotation that further produces circular polarization that is ideal for transmission into a circular waveguide.

Figure 6:
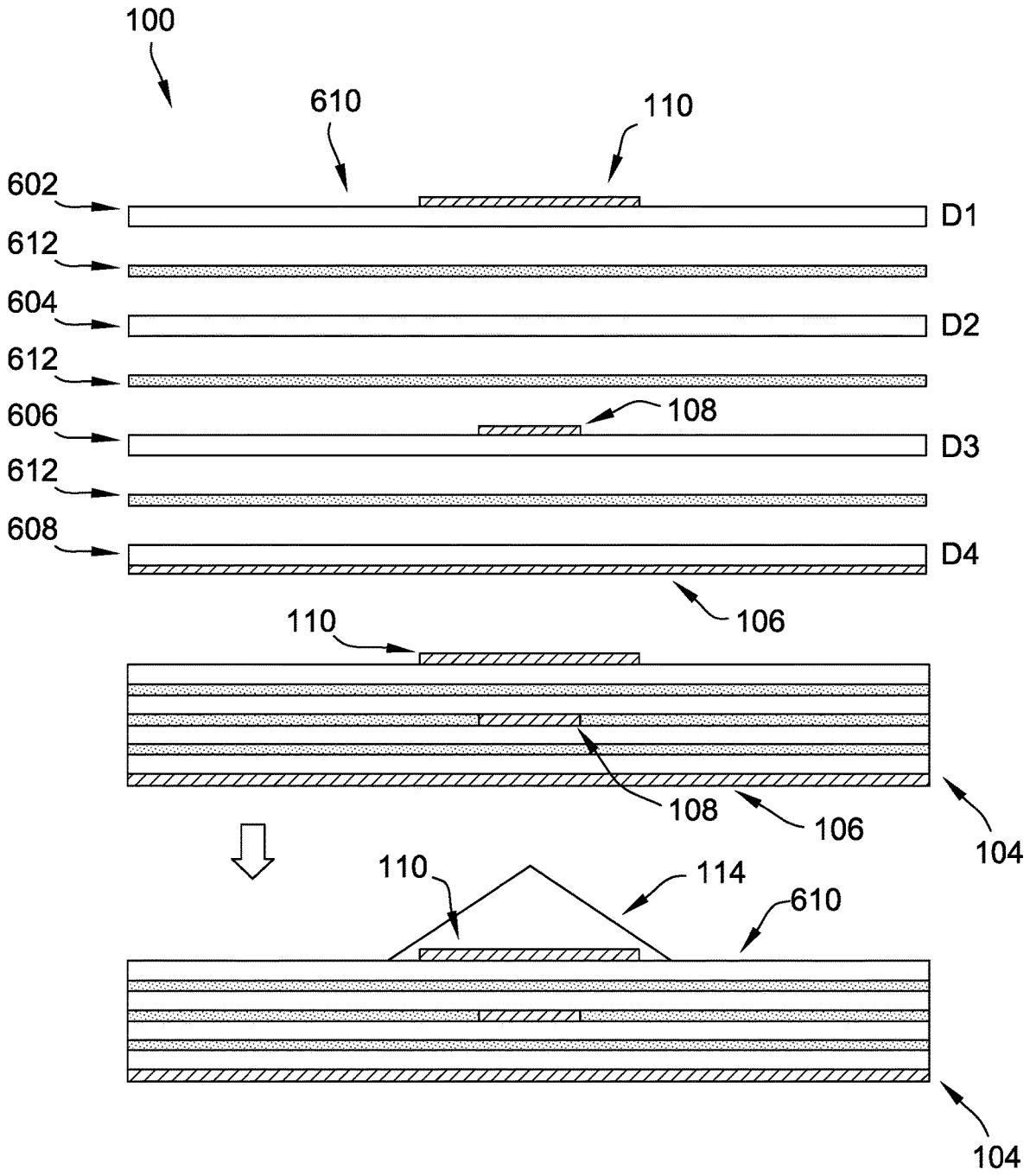
FIG. 6 is a cross-section schematic diagram of the RF PCB shown in FIG. 1.

FIG. 6 is a cross-section schematic diagram of RF PCB 100 shown in FIG. 1. More specifically, FIG. 6 includes various layers of board assembly 104, including dielectric layers, or substrates, conductors, and adhesive films for laminating board assembly 104. Each layer may be fabricated using subtractive methods, such as laser etching, milling, or wet etching, additive methods, such as printing or film deposition, or a combination of both. Board assembly 104 includes a first substrate 602, a second substrate 604, a third substrate 606, and a fourth substrate 608. First substrate 602 includes a top surface 610 on which patch antenna element is disposed. Microstrip transmission line 108 is disposed on third substrate 606, between third substrate 606 and second substrate 604. Ground plane 106 is disposed on fourth substrate 608. First, second, third, and fourth substrates 602, 604, 606, and 608 are laminated, or bonded, together using, for example, adhesive films 612 disposed between each substrate. Microstrip transmission line 108 is embedded in board assembly 104 between ground plane 106 and patch antenna element 110. Notably, as illustrated in FIG. 6, substrates 602 and 604 include no other conductive layers between microstrip transmission line 108 and patch antenna element 110, and thus may be referred to as a single combined substrate having multiple dielectric layers.

In alternative embodiments, additional substrates may be included or certain substrate layers may be excluded. In one alternative embodiments, for example, second substrate 604 is omitted and microstrip transmission line 108 is disposed between first substrate 602 and third substrate 606. Moreover, additional conductive elements may be included on one or more of substrates 602, 604, 606, and 608. For example, in certain embodiments, a tuning element may be disposed on second substrate 604. Such a tuning element is positioned between microstrip transmission line 108 and patch antenna element 110.

Dielectric lens 114 is disposed on patch antenna element 110 and, partially, on top surface 610 of first substrate 602. Dielectric lens 114, like the dielectric layers and conductive layers of board assembly 104, may be deposited using additive methods, such as printing, such that it would extend into an aperture of a waveguide (not shown) mounted, or attached, on top surface 610.

Figure 7:
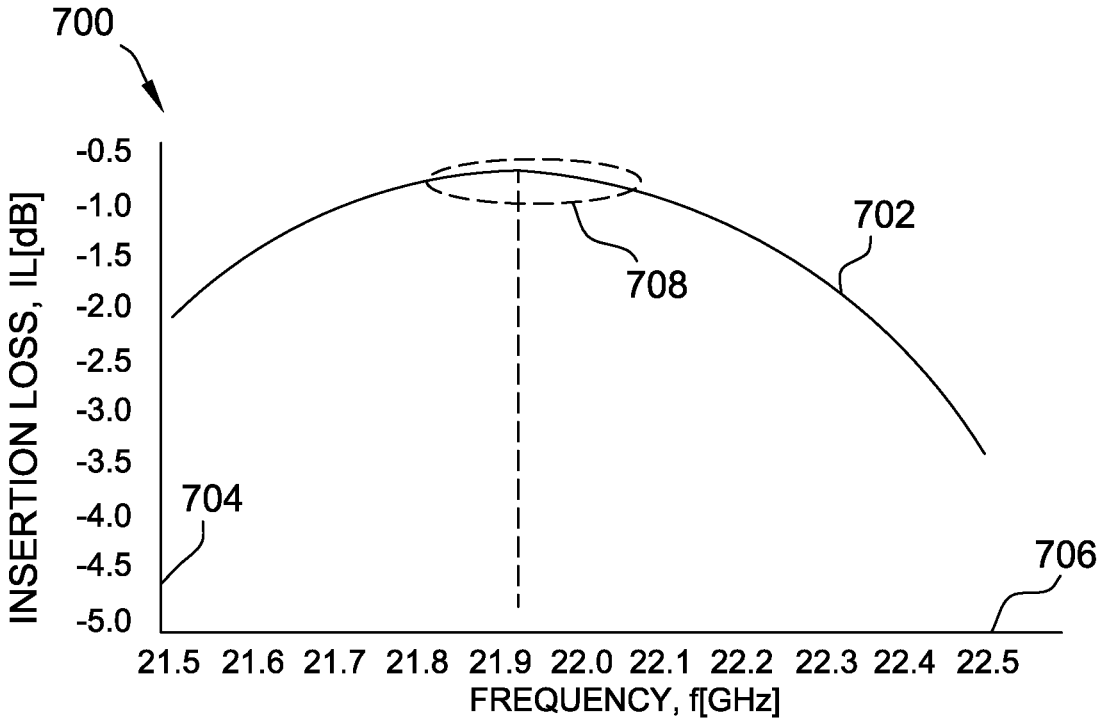
FIG. 7 is an example graph illustrating insertion loss versus frequency for the RF PCB shown in FIG. 1.

FIG. 7 is an example graph 700 of insertion loss versus frequency for RF PCB 100 shown in FIG. 1. Graph 700 includes an insertion loss, IL, plot 702, a vertical axis 704 for insertion loss expressed in decibels (dB), and a horizontal axis 706 for frequency expressed in GHz. Generally, insertion loss, IL, is a performance measure of the power loss through a device, such as, e.g., a waveguide. Here, insertion loss is a performance measure for the microstrip-to-waveguide transition, and may, in certain embodiments, be expressed in dB and generally defined as $10 \log_{10} P_R/P_T$, where $P_T$ is transmitted power and $P_R$ is received power. Insertion loss represents the difference in power transmitted and power received. Accordingly, the magnitude of insertion loss is preferably small, and a large insertion loss generally indicates an inefficient transfer of power through the microstrip-to-waveguide transition. More specifically, power transmitted is power transmitted over the feeding microstrip transmission line 108 to patch antenna element 110 and through dielectric lens 114, and power received is power measured from waveguide 102 at the aperture opposite patch antenna element 110 and dielectric lens 114. Plot 702 illustrates peak performance 708 of RF PCB 100 with respect to insertion loss is about −0.6 dB around an operating frequency of about 21.9 GHz.

Figure 8:
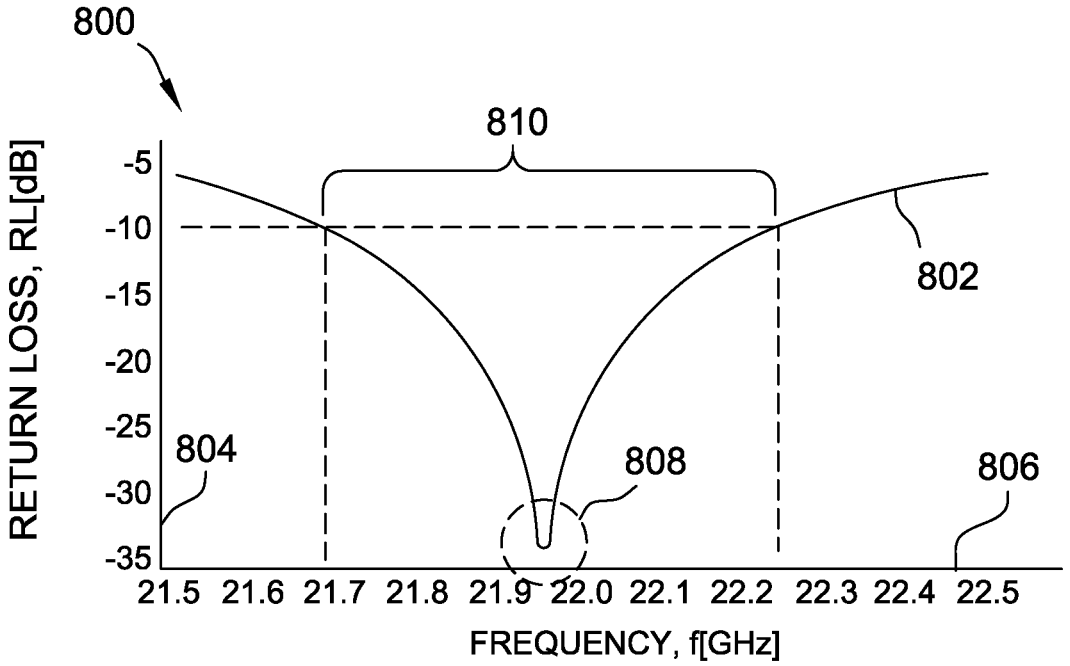
FIG. 8 is an example graph illustrating return loss versus frequency for the RF PCB shown in FIG. 1.

FIG. 8 is an example graph 800 of return loss versus frequency for RF PCB 100 shown in FIG. 1. Graph 800 includes a return loss, RL, plot 802, a vertical axis 804 for return loss expressed in dB, and a horizontal axis 806 for frequency expressed in GHz. Generally, return loss, RL, is a performance measure of the power reflected in a device, such as, e.g., a waveguide. Here, return loss is a measure of reflections occurring at the microstrip-to-waveguide transition of RF PCB 100, and may, in certain embodiments, be expressed in dB and generally defined as $10 \log_{10} P_{ref}/P_i$, where $P_{ref}$ is reflected power and $P_i$ is incident power. More specifically, incident power is power transmitted over the feeding microstrip transmission line 108 to patch antenna element 110 and through dielectric lens 114 into waveguide 102, and reflected power is power reflected by the microstrip-to-waveguide transition back toward patch antenna element 110 and microstrip transmission line 108. Generally, when reflections are low, which is preferred, return loss is large and negative. Plot 802 illustrates peak performance 808 of RF PCB 100 with respect to return loss is about −34 dB around an operating frequency of about 21.95 GHz, and yields a benchmark −10 dB impedance bandwidth 810 of about 550 MHz.

Figure 9:
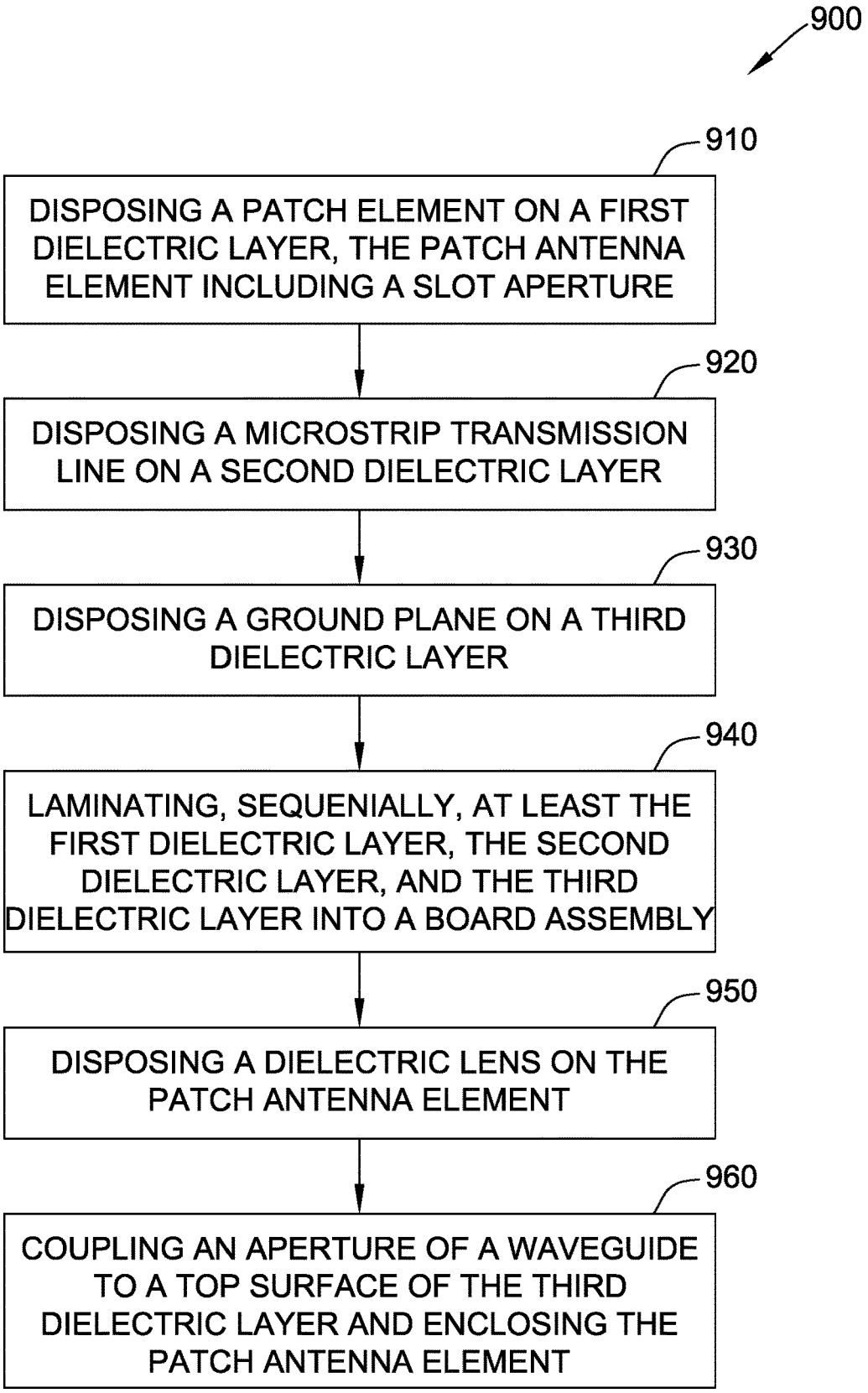
FIG. 9 is a flow diagram of an embodiment of an example method of fabricating an RF PCB, such as that shown in FIG. 1.

FIG. 9 is a flow diagram of an embodiment of an example method 900 of fabricating an RF PCB, such as RF PCB 100 shown in FIG. 1. Method 900 includes disposing 910 patch antenna element 110 on a first dielectric layer, or first substrate 602. The formation of patch antenna element 110 includes forming slot aperture 112 in the conductive material. Microstrip transmission line 108 likewise is disposed 920 on a second dielectric layer, e.g., third substrate 606, and ground plane 106 is disposed 930 on a third dielectric layer, e.g., fourth substrate 608. In certain embodiments, a fourth dielectric layer is included, such as, for example, second substrate 604 shown in FIG. 6 and disposed between first substrate 602 and third substrate 606.

Each of the conductive layers, i.e., ground plane 106, microstrip transmission line 108, and patch antenna element 110, may be formed by subtractive methods, such as laser etching, milling, or wet etching, additive methods, such as printing or film deposition, or a combination of both. For example, disposing 920 microstrip transmission line 108 may include depositing a layer of conductive material onto the second dielectric layer, or substrate 604, and etching the conductive material to form microstrip transmission line 108 to a width corresponding to an impedance value, where the impedance value may further correspond to a desired impedance for microstrip transmission line 108, for example.

Conductive layers are generally formed from an electrically conductive material, such as copper or any other electrically conductive material suitable for use in RF PCBs. In certain embodiments, disposing 920 microstrip transmission line includes depositing a conductive material onto the second dielectric layer, using a printing process, such that microstrip transmission line 108 has a width corresponding to an impedance value, where the impedance value may further correspond to a desired impedance for microstrip transmission line 108, for example. Likewise, in certain embodiments, disposing 930 patch antenna element 110 includes depositing a conductive material onto the third dielectric layer, using a printing process, such that slot aperture 112 includes a length, a width, and an angular orientation corresponding to an operating frequency of RF PCB 100 and, for example, waveguide 102, and such that the patch antenna element has a geometry corresponding to a geometry of the aperture of waveguide 102.

Substrates 602, 604, 606, and 608 a reformed from a dielectric material such as silicon, gallium arsenide, indium phosphide, polytetrafluoroethylene (PTFE) or other polymer, or any other suitable dielectric material. Generally, selections of a dielectric material and its thickness are made based on a desired impedance of transmission lines disposed on the substrate.

The first, second, and third (and fourth, in certain embodiments) dielectric layers are then laminated 940 sequentially to form board assembly 104 such that microstrip transmission line 108 is configured to be electromagnetically coupled to ground plane 106 and electromagnetically coupled to patch antenna element 110 through slot aperture 112. In certain embodiments, laminating 940 includes applying first adhesive film 612 between the first dielectric layer and the second dielectric layer, and applying a second adhesive film 612 between the second dielectric layer and the third dielectric layer. The dielectric layers are then aligned and pressed together.

Dielectric lens 114 is then disposed 950 on board assembly 104 and, more specifically, on patch antenna element 110. Dielectric lens 114 may be deposited using additive methods, such as printing. Dielectric lens 114 may be formed from any suitable dielectric material and, again, is selected along with its size and shape based on a desired impedance and corresponding to an operating frequency of RF PCB 100 and, for example, waveguide 102.

Method 900 includes attaching 960 an aperture of waveguide 102 to top surface 610 of the first dielectric layer and enclosing patch antenna element 110 such that dielectric lens 114 extends into the aperture. Waveguide 102 is configured to be electromagnetically coupled to patch antenna element 110 through dielectric lens 114. In certain embodiments, disposing 950 dielectric lens 114 includes depositing a dielectric material, using a printing process, in a geometry corresponding to a geometry of the aperture of waveguide 102. For example, in alternative embodiments, waveguide 102 is a rectangular waveguide, and disposing dielectric lens 114 includes depositing the dielectric material in a pyramid shape. Further, in certain embodiments, where the geometry of the aperture of waveguide 102 includes a rectangular geometry, patch antenna element 110 includes a linear geometry corresponding to the rectangular geometry of waveguide 102. Similarly, where the geometry of the aperture of waveguide 102 includes a circular geometry, patch antenna element 110 includes a circular geometry corresponding to the circular geometry of waveguide 102.

The systems and methods described herein are not limited to the specific embodiments described herein, but rather, components of the systems and/or steps of the methods may be utilized independently and separately from other components and/or steps described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

As used herein, an element or step recited in the singular and proceeded with the word "a" or "an" should be understood as not excluding plural elements or steps unless such exclusion is explicitly recited. Furthermore, references to "one embodiment" of the present disclosure or "an example embodiment" are not intended to be interpreted as excluding the existence of additional embodiments that also incorporate the recited features.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radio frequency (RF) printed circuit board (PCB), comprising:

a first substrate having a top surface on which a patch antenna element is disposed, the patch antenna element including a slot aperture;

a microstrip transmission line disposed between the first substrate and a second substrate, and configured to be electromagnetically coupled to the patch antenna element through the slot aperture;

a ground plane disposed on a third substrate, the ground plane configured to be electromagnetically coupled to the microstrip transmission line;

a waveguide having an aperture attached to the top surface and enclosing the patch antenna element, the waveguide configured to be electromagnetically coupled to the patch antenna element; and a dielectric lens disposed on the patch antenna element and extending into the aperture of the waveguide.

2. The RF PCB of claim 1, wherein the dielectric lens has a size and shape corresponding to an operating frequency of the waveguide.

3. The RF PCB of claim 2, wherein the waveguide comprises a circular waveguide, and wherein the dielectric lens is conical in shape.

4. The RF PCB of claim 1, wherein the top surface comprises a first surface of the first substrate opposite a second surface of the first substrate, the second surface abutting the microstrip transmission line.

5. The RF PCB of claim 4, wherein the first substrate comprises at least one dielectric layer.

6. The RF PCB of claim 1, wherein the third substrate comprises at least one dielectric layer.

7. The RF PCB of claim 1, wherein the slot aperture includes a length, a width, and an angular orientation corresponding to an operating frequency of the waveguide.

8. The RF PCB of claim 1, wherein the waveguide comprises a rectangular waveguide having an operating frequency, and wherein the patch antenna element includes a linear geometry corresponding to the operating frequency.

9. The RF PCB of claim 1, wherein the waveguide comprises a circular waveguide having an operating frequency, and wherein the patch antenna element includes a circular geometry corresponding to the operating frequency.

10. The RF PCB of claim 1, further comprising a tuning element disposed in a layer of the second substrate and electromagnetically coupled between the microstrip transmission line and the patch antenna element.

11. A method of fabricating a radio frequency (RF) printed circuit board (PCB), comprising:

disposing a patch antenna element on a first dielectric layer, the patch antenna element including a slot aperture;

disposing a microstrip transmission line on a second dielectric layer;

disposing a ground plane on a third dielectric layer;

laminating, sequentially, at least the first dielectric layer, the second dielectric layer, and the third dielectric layer into a board assembly such that the microstrip transmission line is configured to be electromagnetically coupled to the ground plane and electromagnetically coupled to the patch antenna element through the slot aperture;

disposing a dielectric lens on the patch antenna element; and attaching an aperture of a waveguide to a top surface of the first dielectric layer and enclosing the patch antenna element such that the dielectric lens extends into the aperture of the waveguide, the waveguide configured to be electromagnetically coupled to the patch antenna element through the dielectric lens.

12. The method of claim 11, wherein disposing the dielectric lens comprises depositing a dielectric material, using a printing process, in a size and shape corresponding to an operating frequency of the waveguide.

13. The method of claim 12, wherein the waveguide comprises a rectangular waveguide, and disposing the dielectric lens comprises depositing the dielectric material in a pyramid shape.

14. The method of claim 12, wherein disposing the dielectric lens comprises depositing a dielectric material, using a printing process, in a geometry corresponding to a geometry of the aperture of the waveguide.

15. The method of claim 11, wherein disposing the microstrip transmission line comprises depositing a conductive material onto the second dielectric layer, using a printing process, such that the microstrip transmission line has a width corresponding to an impedance value.

16. The method of claim 11, wherein disposing the patch antenna element comprises depositing a conductive material onto the first dielectric layer, using a printing process, such that the slot aperture includes a length, a width, and an angular orientation corresponding to an operating frequency of the waveguide, and such that the patch antenna element has a geometry corresponding to a geometry of the aperture of the waveguide.

17. The method of claim 16, wherein the geometry of the aperture of the waveguide includes a rectangular geometry, and the patch antenna element includes a linear geometry corresponding to the rectangular geometry of the waveguide.

18. The method of claim 16, wherein the geometry of the aperture of the waveguide includes a circular geometry, and the patch antenna element includes a circular geometry corresponding to the circular geometry of the waveguide.

19. The method of claim 11, wherein disposing the microstrip transmission line comprises:

depositing a layer of a conductive material onto the second dielectric layer; and etching the conductive material to form the microstrip transmission line having a width corresponding to an impedance value.

20. The method of claim 11, wherein laminating comprises:

applying a first adhesive film between the first dielectric layer and the second dielectric layer; and applying a second adhesive film between the second dielectric layer and the third dielectric layer.

* * * * *